US008708725B2

(12) United States Patent
Shimada

(10) Patent No.: US 8,708,725 B2
(45) Date of Patent: Apr. 29, 2014

(54) ELECTRICAL CONNECTOR HAVING AN OBSERVABLE DISCRIMINATIVE AREA

(75) Inventor: Yoshinobu Shimada, Tokyo (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 28 days.

(21) Appl. No.: 13/468,387

(22) Filed: May 10, 2012

(65) Prior Publication Data

US 2012/0289092 A1 Nov. 15, 2012

(30) Foreign Application Priority Data

May 12, 2011 (JP) ..... 2011-106949

(51) Int. Cl.
*H01R 13/15* (2006.01)
*H01R 13/62* (2006.01)

(52) U.S. Cl.
USPC ..... 439/260; 439/491; 439/495

(58) Field of Classification Search
USPC ..... 439/260, 495, 488, 491
See application file for complete search history.

(56) References Cited

U.S. PATENT DOCUMENTS 6,361,355 B1 * 3/2002 Matsuoka et al. ..... 439/488
6,731,844 B2 * 5/2004 Conrad et al. ..... 385/114
7,044,773 B2 * 5/2006 Suzuki et al. ..... 439/495
7,056,149 B1 * 6/2006 Lanni ..... 439/488
7,241,151 B1 * 7/2007 Bradshaw ..... 439/95
7,452,227 B2 * 11/2008 Matoba et al. ..... 439/260
7,540,764 B2 * 6/2009 Suzuki et al. ..... 439/495
7,766,680 B2 * 8/2010 Suzuki et al. ..... 439/260
7,785,121 B2 * 8/2010 Ito et al. ..... 439/260
2004/0266242 A1 * 12/2004 Shiu et al. ..... 439/260
2007/0032115 A1 * 2/2007 Takashita ..... 439/260
2007/0049087 A1 * 3/2007 Hashimoto et al. ..... 439/260
2009/0130881 A1 * 5/2009 Suzuki et al. ..... 439/260

FOREIGN PATENT DOCUMENTS

JP 2004-355868 A 12/2004

* cited by examiner

*Primary Examiner* — Hae Moon Hyeon
(74) *Attorney, Agent, or Firm* — Studebaker & Brackett PC

(57) ABSTRACT

An electrical connector including a housing to be mounted on an outer surface of a main circuit board, conductive contacts arranged in the housing and an actuator operative to take selectively a first station for releasing each of the conductive contacts from press-contact with one of connecting terminals on a flat circuit device inserted in the housing and a second station for causing each of the conductive contacts to maintain the press-contact with the connecting terminal, wherein the actuator has a particular outer portion thereof which faces upward on the outer surface of the main circuit board when the actuator takes one of the first and second stations and faces toward a direction in parallel with the outer surface of the main circuit board when the actuator takes the other of the first and second stations.

9 Claims, 10 Drawing Sheets

ELECTRICAL CONNECTOR HAVING AN OBSERVABLE DISCRIMINATIVE AREA

BACKGROUND OF THE INVENTION

1. Field of the Invention

The present invention relates generally to an electrical connector, and more particularly to an improvement in an electrical connector having a plurality of conductive contacts which are connected with a main circuit board, such as a solid printed circuit board, and provided for coming into press-contact with connecting terminals provided on a flat circuit device, such as a flexible printed circuit board (FPC) or a flat flexible cables (FFC), so as to put the connecting terminals provided on the flat circuit device in electrical connection with the main circuit board.

2. Description of the Prior Art Including Information Disclosed Under 37 CFR 1.97 and 37 CFR 1.98

A flat circuit device, such as a relatively small-sized flexible printed circuit board or the like, used in electronic apparatus of various kinds is often mounted on a main circuit board, such as a solid printed circuit board, on which various electrical parts are directly mounted, by means of an electrical connector which is fixed to and connected electrically with the main circuit board. The electrical connector has a plurality of conductive contacts for coming into contact with connecting terminals provided on the flat circuit device and is operative to connect electrically, through the conductive contacts, the connecting terminals provided on the flat circuit device with conductive circuit pattern portions formed on the main circuit board.

For example, a previously proposed electrical connector, which is used for mounting a flexible printed circuit board as the flat circuit device on a main circuit board, is provided with a housing made of insulator to be mounted on the main circuit board. The housing has an opening through which at least a part of the flexible printed circuit board is inserted into the housing. In the housing, a plurality of conductive contacts are provided to be arranged along the opening. These conductive contacts are operative to come into contact respectively with a plurality of connecting terminals provided on the flexible printed circuit board when the flexible printed circuit board is inserted into the housing through the opening. The electrical connector is further provided with an actuator which is provided to be rotatable to the housing so as to engage with each of the conductive contacts arranged in the housing. When the actuator is rotated in regard to the housing, each of the conductive contacts is caused by the actuator to maintain press-contact with a corresponding one of the connecting terminals provided on the flexible printed circuit board.

For example, the actuator is formed in a slender shape elongating in a direction along which the conductive contacts are arranged and provided thereon with a manipulatable portion. Then, the actuator is rotated in regard to the housing when the manipulatable portion of the actuator is manipulated.

Each of the conductive contacts arranged in the housing is made of conductive resilient material to have a fixed portion fixed to the housing to be electrically connected with a conductive circuit pattern portion formed on the main circuit board on which the housing is mounted and a contacting portion for coming into press-contact with the connecting terminal provided on the flexible printed circuit board inserted in the housing through the opening provided thereon. The connecting portion of each of the conductive contacts postures selectively to come into press-contact with the connecting terminal provided on the flexible printed circuit board and to be released from the press-contact with the connecting terminal provided on the flexible printed circuit board in response to a situation of the flexible printed circuit board to be inserted in the housing and a situation of the actuator to be rotated in regard to the housing.

In the previously proposed electrical connector as mentioned above, under a condition wherein the flexible printed circuit board is inserted into the housing mounted on the main circuit board through the opening provided on the housing, the manipulatable portion of the actuator is manipulated to rotate the actuator in its entirety in regard to the housing for causing the connecting portion of each of the conductive contacts to maintain press-contact with a corresponding one of the connecting terminals provided on the flexible printed circuit board so that the connecting terminals provided on the flexible printed circuit board are surely connected electrically with the conductive circuit pattern portion formed on the main circuit board. On that occasion, the electrical connector is required to indicate clearly a condition wherein the actuator is operating to cause the connecting portion of each of the conductive contacts to maintain press-contact with the connecting terminal provided on the flexible printed circuit board to be distinguishable from a condition wherein the actuator is operating to release the connecting portion of each of the conductive contacts from the press-contact with the connecting terminal provided on the flexible printed circuit board, by means of observation from the outside of the housing.

Therefore, there has been also proposed an electrical connector comprising a housing made of insulator, a plurality of conductive contacts and an actuator rotatable in regard to the housing provided in such a manner as described above, in which a part of the housing or a part of the actuator varies in its color between a condition wherein the actuator is operating to cause each of the conductive contacts to maintain press-contact with a connecting terminal provided on a flexible printed circuit board inserted in the housing and a condition wherein the actuator is operating to release each of the conductive contacts from the press-contact with the connecting terminal provided on the flexible printed circuit board, so that the condition wherein the actuator is operating to cause each of the conductive contacts to maintain the press-contact with the connecting terminal provided on the flexible printed circuit board inserted in the housing, can be recognized by means of observation from the outside of the housing, as shown in, for example, the Japanese patent application published before examination under publication number 2004-355868 (Published patent document 1).

An electrical connector (a connector 30; 50) shown in the published patent document 1 comprises a housing made of insulator (connector body 32: 52) and provided thereon with an opening (38), a plurality of contacts (connector's connecting terminal 36) and an actuator (rocking member 34; 54). Under a condition wherein the actuator (34; 54) takes a first station to keep rising from the housing (32; 52) as shown in FIGS. 1 and 7, a flexible printed circuit board (a flexible board 12) is inserted in the housing (32; 52) through the opening (38) provided thereon. Then, when the actuator (34; 54) is manipulated to be rotated from the first station to a second station to keep lying down on the housing (32; 52) as shown in FIGS. 4 and 8, the flexible printed circuit board (12) inserted in the housing (32; 52) through the opening (38) is put between a contacting portion (a first contacting portion 36A) of each of the conductive contacts (36) and the actuator (34; 54). Thereby, the contacting portion (36A) of each of the conductive contacts (36) is caused to keep press-contacting with a connecting terminals (flexible board terminal 18A) provided on the flexible printed circuit board (12).

In the electrical connector (30), a pressing portion (34B) provided on the actuator (34) is put in engagement with a depression (32A) provided on the housing (32; 52). Further, in the electrical connector (50), an electronic paper (56) stuck on the actuator (54) is moved to approach a magnetic member (a first magnetic member 20) provided on the flexible printed circuit board (12).

A press-discoloring member (44) is positioned in the depression (32A) provided on the housing (32) of the electrical connector (30). When the pressing portion (34B) provided on the actuator (34) engages with the depression (32A), the pressing portion (34B) is operative to press the press-discoloring member (44) so that the press-discoloring member (44) becomes discolored. A part of the housing (32) at which the press-discoloring member (44) is formed is made of transparent material and therefore the discoloration of the press-discoloring member (44) in the depression (32A) can be observed from the outside of the housing (32) of the electrical connector (30) as a change of color of the part of the housing (32).

The electronic paper (56) stuck on the actuator (54) of the electronic connector (50) is operative to discolor with magnetic attraction from the magnetic member (20) provided on the flexible printed circuit board (12) when electronic paper (56) is moved to approach the magnetic member (20). The electronic paper (56) is stuck on an outer surface of the actuator (54) and therefore the discoloration of the electronic paper (56) can be observed from the outside of the housing (52) of the electrical connector (50) as a change of color of the part of the actuator (54).

As described above, in the electrical connector (30) shown in the published patent document 1, the press-discoloring member (44) positioned in the depression (32A) provided on the housing (32) is pressed by the pressing portion (34B) provided on the actuator (34) to become discolored, so that the part of the housing (32) varies in its color between a condition wherein the actuator (34) is operating to cause each of the conductive contacts (36) to maintain press-contact with the connecting terminal (18A) provided on the flexible printed circuit board (12) inserted in the housing (32) and a condition wherein the actuator (34) is operating to release each of the conductive contacts (36) from the press-contact with the connecting terminal (18A) provided on the flexible printed circuit board (12), and in the electrical connector (50) also shown in the published patent document 1, the electronic paper (56) stuck on the actuator (54) is operative to discolor with the magnetic attraction from the magnetic member (20) provided on the flexible printed circuit board (12), so that the part of the actuator (54) varies in its color between a condition wherein the actuator (54) is operating to cause each of the conductive contacts (36) to maintain the press-contact with the connecting terminal (18A) provided on the flexible printed circuit board (12) inserted in the housing (52) and a condition wherein the actuator (54) is operating to release each of the conductive contacts (36) from the press-contact with the connecting terminal (18A) provided on the flexible printed circuit board (12).

As a result, in the electrical connector (30; 50) shown in the published patent document 1, the condition wherein the actuator (34; 54) is operating to cause each of the conductive contacts (36) to maintain the press-contact with the connecting terminal (18A) provided on the flexible printed circuit board (12) inserted in the housing (32; 52), can be recognized by means of observation from the outside of the housing (32; 52).

In each of the electrical connectors thus proposed previously to be used for mounting the flexible printed circuit board on the main circuit board, with which the condition wherein the actuator provided to be rotatable in regard to the housing is operating to cause each of the conductive contacts arranged in the housing to maintain press-contact with the connecting terminal provided on the flexible printed circuit board inserted in the housing, can be recognized by means of observation from the outside of the housing, it is required to provide on the housing with the depression in which the press-discoloring member is put and in addition to provide on the actuator with the pressing portion for engaging with the depression formed on the housing, or to provide with the magnetic member on the flexible printed circuit board to be inserted in the housing through the opening provided thereon and in addition to provide on the actuator with the electronic paper for moving to approach the magnetic member on the flexible printed circuit board inserted in the housing dependently upon the station of the actuator.

This means that the electrical connector is required to have a specific member such as a press-discoloring member operative to be caused by a pressure exerted thereon to discolor or an electrical paper operative to be caused by a magnetic member to discolor and each of the housing and the actuator of the electrical connector is unwillingly complicated in its configuration. As a result, a rise in production cost of the electrical connector is undesirably brought about.

BRIEF SUMMARY OF THE INVENTION

Accordingly, it is an object of the present invention to provide an electrical connector used, for example, for mounting a flat circuit device, such as a flexible printed circuit board, on a main circuit board, which comprises a housing made of insulator and provided with an opening through which the flat circuit device is inserted into the housing, a plurality of conductive contacts provided to be arranged in the housing, and an actuator provided to be rotatable in regard to the housing for engaging with the conductive contacts and operative to be rotated to take selectively a first station for causing the conductive contacts to come into press-contact with connecting terminals provided on the flat circuit device inserted into the housing through the opening provided thereon and a second station for releasing the conductive contacts from the press-contact with the connecting terminals on the flat circuit device, and which avoids the aforementioned disadvantages encountered with the prior art.

Another object of the present invention is to provide an electrical connector used, for example, for mounting a flat circuit device, such as a flexible printed circuit board, on a main circuit board, which comprises a housing made of insulator and provided with an opening through which the flat circuit device is inserted into the housing, a plurality of conductive contacts provided to be arranged in the housing, and an actuator provided to be rotatable in regard to the housing for engaging with the conductive contacts and operative to be rotated to take selectively a first station for causing the conductive contacts to come into press-contact with connecting terminals provided on the flat circuit device inserted into the housing through the opening provided thereon and a second station for releasing the conductive contacts from the press-contact with the connecting terminals on the flat circuit device, and with which a condition wherein the actuator is operating to cause each of the conductive contacts to maintain the press-contact with the connecting terminal provided on the flat circuit device inserted in the housing can be distinguished easily and clearly from a condition wherein the actuator is operating to release each of the conductive contacts from the press-contact with the connecting terminal on the flat circuit device, by means of observation from the outside of the housing, with a structure in which any specific member such as a press-discoloring member or an electrical paper is not necessary to be provided on the housing or the actuator and thereby each of the housing and the actuator is simplified in its configuration.

A further object of the present invention is to provide an electrical connector used, for example, for mounting a flat circuit device, such as a flexible printed circuit board, on a main circuit board, which comprises a housing made of insulator and provided with an opening through which the flat circuit device is inserted into the housing, a plurality of conductive contacts provided to be arranged in the housing, and an actuator provided to be rotatable in regard to the housing for engaging with the conductive contacts and operative to be rotated to take selectively a first station for causing the conductive contacts to come into press-contact with connecting terminals provided on the flat circuit device inserted into the housing through the opening provided thereon and a second station for releasing the conductive contacts from the press-contact with the connecting terminals on the flat circuit device, and with which a condition wherein the actuator is operating to cause each of the conductive contacts to maintain the press-contact with the connecting terminal provided on the flat circuit device inserted in the housing can be distinguished easily and clearly from a condition wherein the actuator is operating to release each of the conductive contacts from the press-contact with the connecting terminal on the flat circuit device, by means of observation from the outside of the housing, with a structure with which a production cost of the electrical connector is reduced.

According to the present invention, as claimed in any one of claims, there is provided an electrical connector, which comprises a housing made of insulator to be mounted on an outer surface of a main circuit board and provided with an opening through which a flat circuit device is inserted into the housing, a plurality of conductive contacts provided to be arranged in the housing and positioned to correspond respectively to connecting terminals provided on the flat circuit device when the flat circuit device is inserted in the housing through the opening provided thereon, and an actuator provided to be rotatable in regard to the housing for taking a first station and a second station selectively to engage with the conductive contacts for causing each of the conductive contacts to come into press-contact with one of the connecting terminals corresponding thereto when the flat circuit device is inserted in the housing through the opening provided thereon and the actuator is shifted from the first station to the second station and for releasing each of the conductive contacts from the press-contact with the corresponding one of the connecting terminals when the flat circuit device has been inserted in the housing and the actuator is shifted from the second station to the first station, wherein the actuator has a particular outer portion thereof which faces upward on the outer surface of the main circuit board on which the housing is mounted when the actuator takes the first station and faces toward a direction in parallel with the outer surface of the main circuit board on which the housing is mounted when the actuator takes the second station or faces toward a direction in parallel with the outer surface of the main circuit board on which the housing is mounted when the actuator takes the first station and faces upward on the outer surface of the main circuit board on which the housing is mounted when the actuator takes the second station, and a discriminative area presenting a color or an ornamental pattern different from that on other areas on the actuator and the housing is provided on the particular outer portion of the actuator.

In the electrical connector thus constituted in accordance with the present invention, under a condition wherein the housing is mounted on the outer surface of the main circuit board, the actuator positioned in the first station keeps rising from the outer surface of the main circuit board and the actuator positioned in the second station keeps lying down on the outer surface of the main circuit board.

When the actuator is rotated to shift from the first station wherein the actuator keeps rising from the outer surface of the main circuit board on which the housing is mounted to the second station wherein the actuator keeps lying down on the outer surface of the main circuit board on which the housing is mounted after the flat circuit board has been inserted in the housing through the opening provided thereon, the actuator positioned in the second station is operating to cause each of the conductive contacts to maintain press-contact with a corresponding one of the connecting terminal provided on the flat circuit device inserted in the housing. Then, the actuator is rotated to shift from the second station wherein the actuator keeps laying down on the outer surface of the main circuit board on which the housing is mounted to the first station wherein the actuator keeps rising from the outer surface of the main circuit board on which the housing is mounted after the flat circuit board has been inserted in the housing through the opening provided thereon, the actuator positioned in the first station is operating to release each of the conductive contacts from the press-contact with the corresponding one of the connecting terminal provided on the flat circuit device inserted in the housing.

When the actuator is positioned in the first station so as to keep rising from the outer surface of the main circuit board on which the housing is mounted, the particular portion of the actuator on which the discriminative area is provided faces upward on the outer surface of the main circuit board or faces toward the direction in parallel with the outer surface of the main circuit board and thereby the discriminative area provided on the particular portion of the actuator also faces upward on the outer surface of the main circuit board or faces toward the direction in parallel with the outer surface of the main circuit board. On the other hand, when the actuator is positioned in the second station so as to keep lying down on the outer surface of the main circuit board on which the housing is mounted, the particular portion of the actuator on which the discriminative area is provided faces toward the direction in parallel with the outer surface of the main circuit board or faces upward on the outer surface of the main circuit board and thereby the discriminative area provided on the particular portion of the actuator also faces toward the direction in parallel with the outer surface of the main circuit board or faces upward on the outer surface of the main circuit board.

In the electrical connector thus constituted in accordance with the present invention, the discriminative area on the particular outer portion of the actuator is provided to present the color or the ornamental pattern different from that on other areas on the actuator and the housing. Accordingly, when the actuator is positioned in the first station to keep rising from the outer surface of the main circuit board on which the housing is mounted for releasing each of the conductive contacts from the press-contact with the connecting terminal provided on the flat circuit device inserted in the housing and therewith the discriminative area on the particular outer portion of the actuator faces upward on the outer surface of the main circuit board, or when the actuator is positioned in the second station to keep lying down on the outer surface of the main circuit board on which the housing is mounted for causing each of the conductive contacts to maintain the press-contact with the connecting terminal provided on the flat circuit device inserted in the housing and therewith the discriminative area on the particular outer portion of the actuator faces upward on the outer surface of the main circuit board, the discriminative area on the particular outer portion of the actuator becomes conspicuous in a sight of birds eye view on the outer surface of the main circuit board and therefore the actuator positioned in the first or second station can be recognized quite easily by observation from the outside of the housing.

On the other hand, when the actuator is positioned in the second station to keep lying down on the outer surface of the main circuit board on which the housing is mounted for causing each of the conductive contacts to maintain the press-contact with the connecting terminal provided on the flat circuit device inserted in the housing and therewith the discriminative area on the particular outer portion of the actuator faces toward the direction in parallel with the outer surface of the main circuit board, or when the actuator is positioned in the first station to keep rising from the outer surface of the main circuit board on which the housing is mounted for releasing each of the conductive contacts from the press-contact with the connecting terminal provided on the flat circuit device inserted in the housing and therewith the discriminative area on the particular outer portion of the actuator faces toward the direction in parallel with the outer surface of the main circuit board, the discriminative area on the particular outer portion of the actuator becomes inconspicuous in a sight of birds eye view on the outer surface of the main circuit board and therefore the actuator positioned in the second or first station can be recognized quite easily by observation from the outside of the housing.

Consequently, with the electrical connector according to the present invention, the condition wherein the actuator is operating to cause each of the conductive contacts to maintain the press-contact with the connecting terminal provided on the flat circuit device inserted in the housing can be distinguished easily and clearly from the condition wherein the actuator is operating to release each of the conductive contacts from the press-contact with the connecting terminal on the flat circuit device, by means of observation in the sight of birds eye view on the outer surface of the main circuit board, that is, observation from the outside of the housing.

Further, such easy and clear distinction by means of observation from the outside of the housing can be obtained with the discriminative area provided on the particular outer portion of the actuator, which presents the color or the ornamental pattern different from that on other areas on the actuator and the housing and is operative to face upward on the outer surface of the main circuit board on which the housing is mounted when the actuator is positioned in the first station and to face toward the direction in parallel with the outer surface of the main circuit board on which the housing is mounted when the actuator is positioned in the second station, or operative to face toward the direction in parallel with the outer surface of the main circuit board on which the housing is mounted when the actuator is positioned in the first station and to face upward on the outer surface of the main circuit board on which the housing is mounted when the actuator is positioned in the second station. Accordingly, the electrical connector according to the present invention can be constituted with a structure in which any specific member such as a press-discoloring member or an electrical paper is not necessary to be provided on the housing or the actuator and thereby each of the housing and the actuator is simplified in its configuration and with which a production cost of the electrical connector is reduced.

As a result, with the electrical connector according to the present invention, the condition wherein the actuator is operating to cause each of the conductive contacts to maintain the press-contact with the connecting terminal provided on the flat circuit device inserted in the housing can be distinguished easily and clearly from a condition wherein the actuator is operating to release each of the conductive contacts from the press-contact with the connecting terminal on the flat circuit device, by means of observation from the outside of the housing, with the structure in which any specific member such as the press-discoloring member or the electrical paper is not necessary to be provided on the housing or the actuator and thereby each of the housing and the actuator is simplified in its configuration and with which the production cost of the electrical connector is reduced.

The above, and other objects, features and advantages of the present invention will become apparent from the following detailed description taken in conjunction with the accompanying drawings.

DETAILED DESCRIPTION OF THE INVENTION

Figure 1:
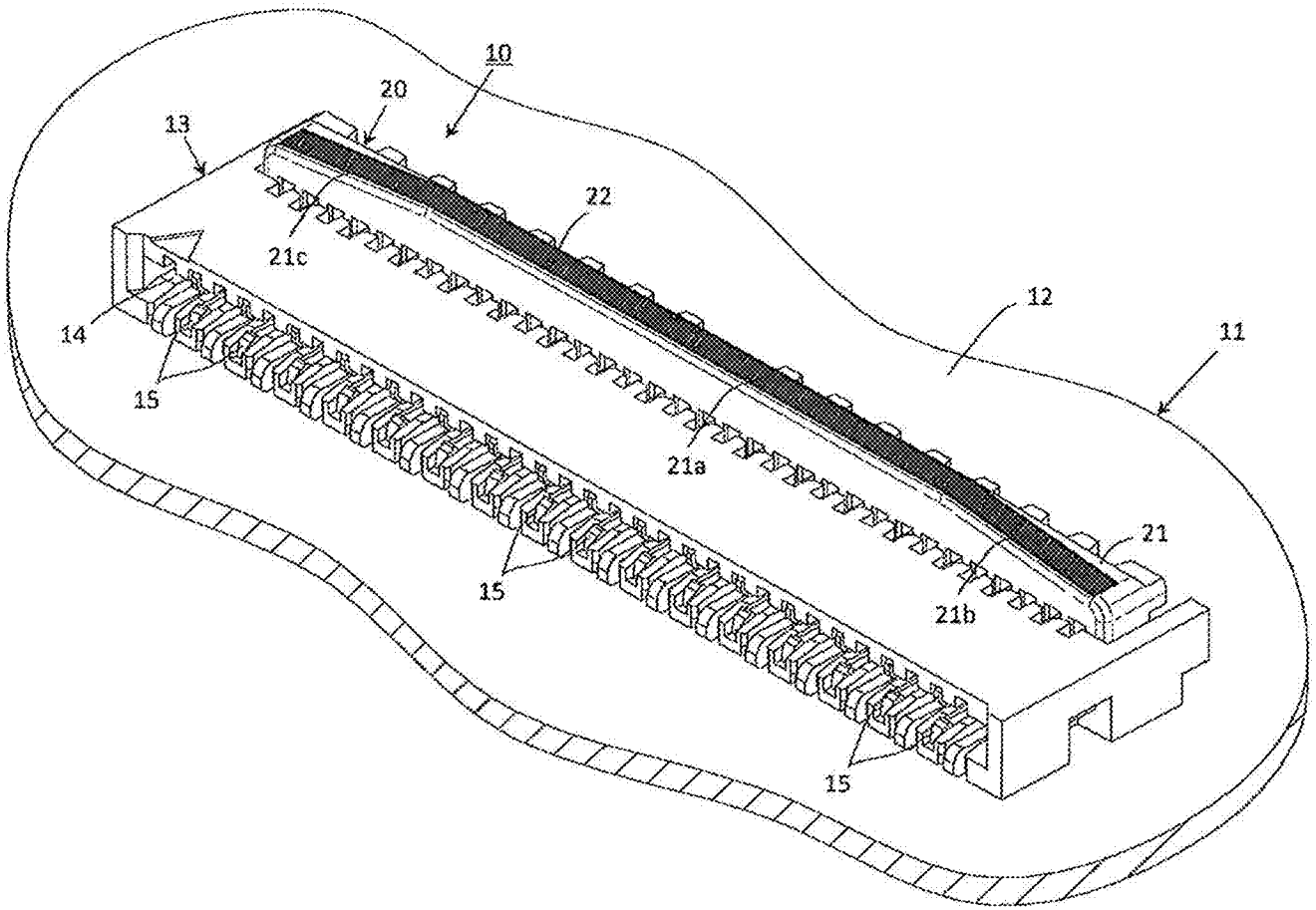
FIG. 1 is a schematic perspective view showing a first embodiment of electrical connector according to the present invention, together with a part of a main circuit board of an electronic apparatus to which the first embodiment is fixed.
Figure 2:
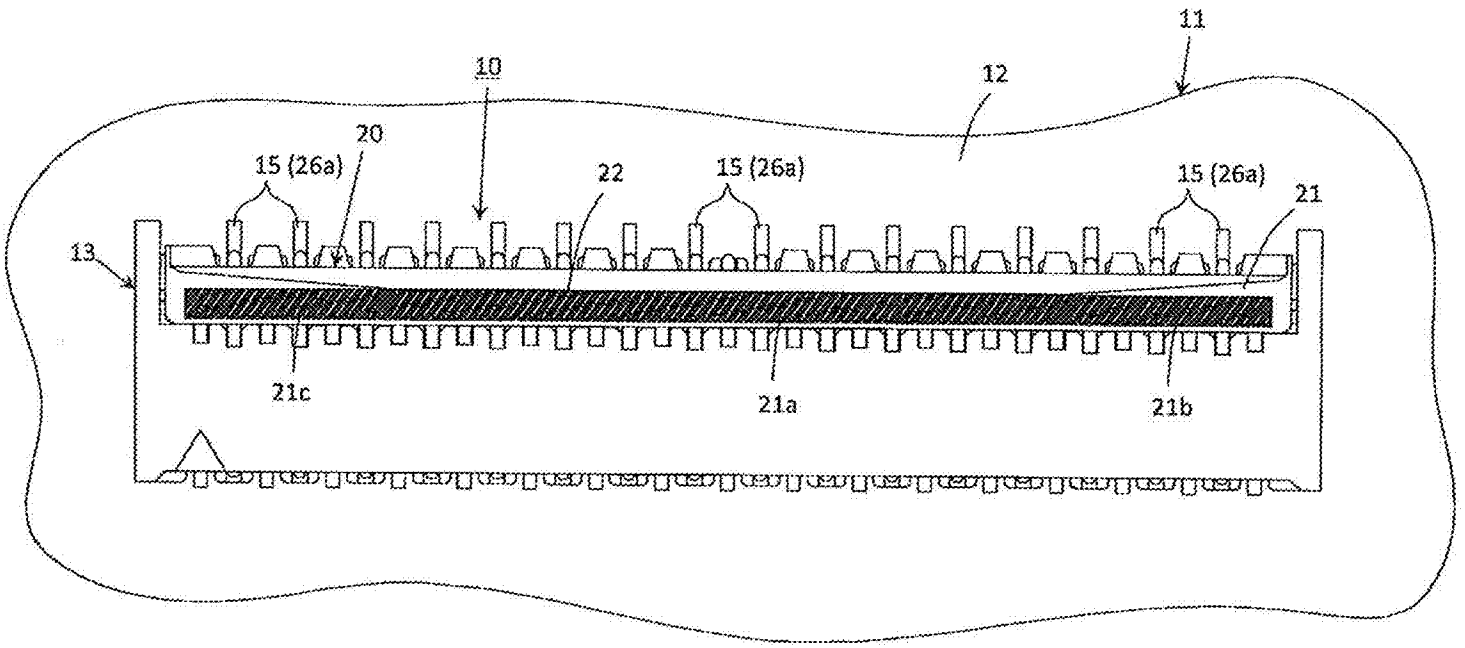
FIG. 2 is a schematic plan view showing the first embodiment of electrical connector according to the present invention, together with a part of the main circuit board of the electronic apparatus to which the first embodiment is fixed.
Figure 3:
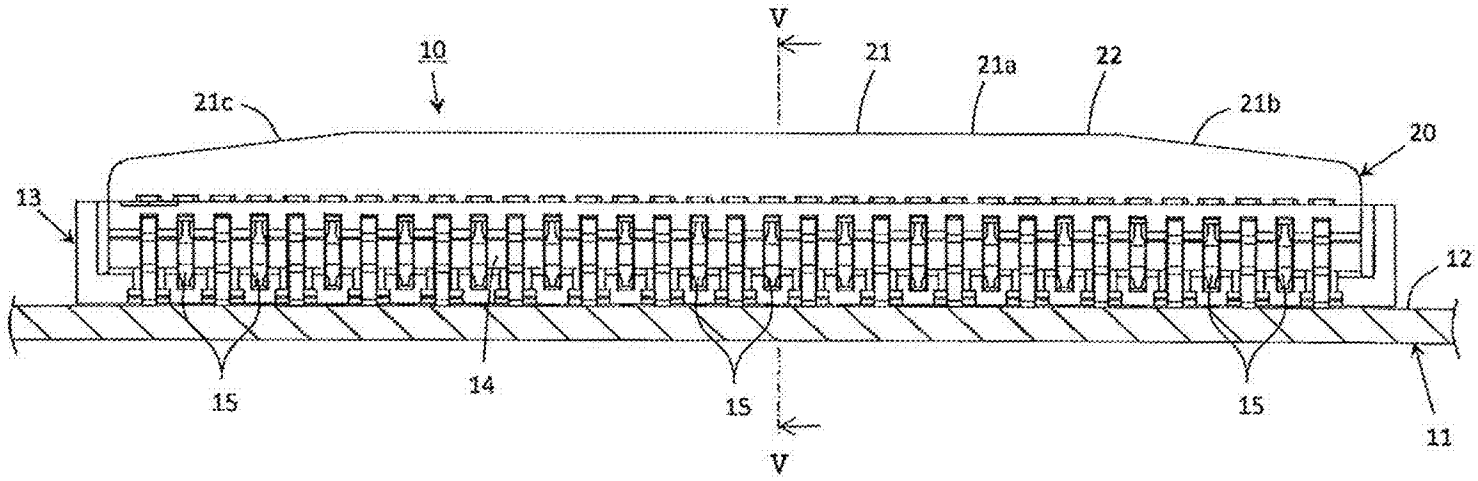
FIG. 3 is a schematic front view showing the first embodiment of electrical connector according to the present invention, together with a part of the main circuit board of the electronic apparatus to which the first embodiment is fixed.

Each of FIG. 1 which is a schematic perspective view, FIG. 2 is a schematic plan view and FIG. 3 which is a schematic front view, shows a first embodiment of electrical connector according to the present invention, together with a part of a main circuit board on which the first embodiment is fixed.

Referring to FIGS. 1 to 3, an electrical connector 10, which constitutes the first embodiment of electrical connector according to the present invention, has a housing 13 made of insulator such as plastics or the like. When the electrical connector 10 is put in practical use, the housing 13 is mounted on an outer surface 12 of a main circuit board 11 of an electronic apparatus (not shown in the drawings), so that the electrical connector 10 is fixed as a whole to the main circuit board 11. Various electronic parts may be mounted directly on the outer surface 12 of the main circuit board 11 in addition to the housing 13 of the electrical connector 10.

The housing 13 is provided with an opening 14 through which a flat circuit device is inserted in the housing 13. For example, a part of a flexible printed circuit board 40 (shown in FIGS. 6 and 7 described later) as the flat circuit device is inserted into the housing 13 through the opening 14 provided thereon.

A plurality of conductive contacts 15, each of which is made of conductive resilient material, are provided in the housing 13 of the electrical connector 10 to be arranged in a longitudinal direction of the housing 13. Each of the conductive contacts 15 elongates in a direction along which the part of the flexible printed circuit board 40 is inserted into the housing 13 and drawn out of the housing 13 so as to have a major part thereof accommodated in the housing 13 and an end portion projecting from a rear end portion of the housing 13 to the outside thereof to form a connecting terminal, as shown in FIG. 2.

The electrical connector 10 has also an actuator 20 which is provided on the rear end portion of the housing 13 to be rotatable in regard to the housing 13. The actuator 20 is, for example, made of insulator of the same kind as the insulator of which the housing 13 is made so as to present the same color as the housing 13 or a color similar to the housing 13 and shaped into a slender member elongating along the arrangement of the conductive contacts 15 so that a longitudinal direction of the actuator 20 is the same as the longitudinal direction of the housing 13. In case each of the housing 13 and the actuator 20 is made of insulator of the same kind, the insulator used for making the housing 13 and the actuator 20 is easy to charge and thereby a production cost of each of the housing 13 and the actuator 20.

Figure 6:
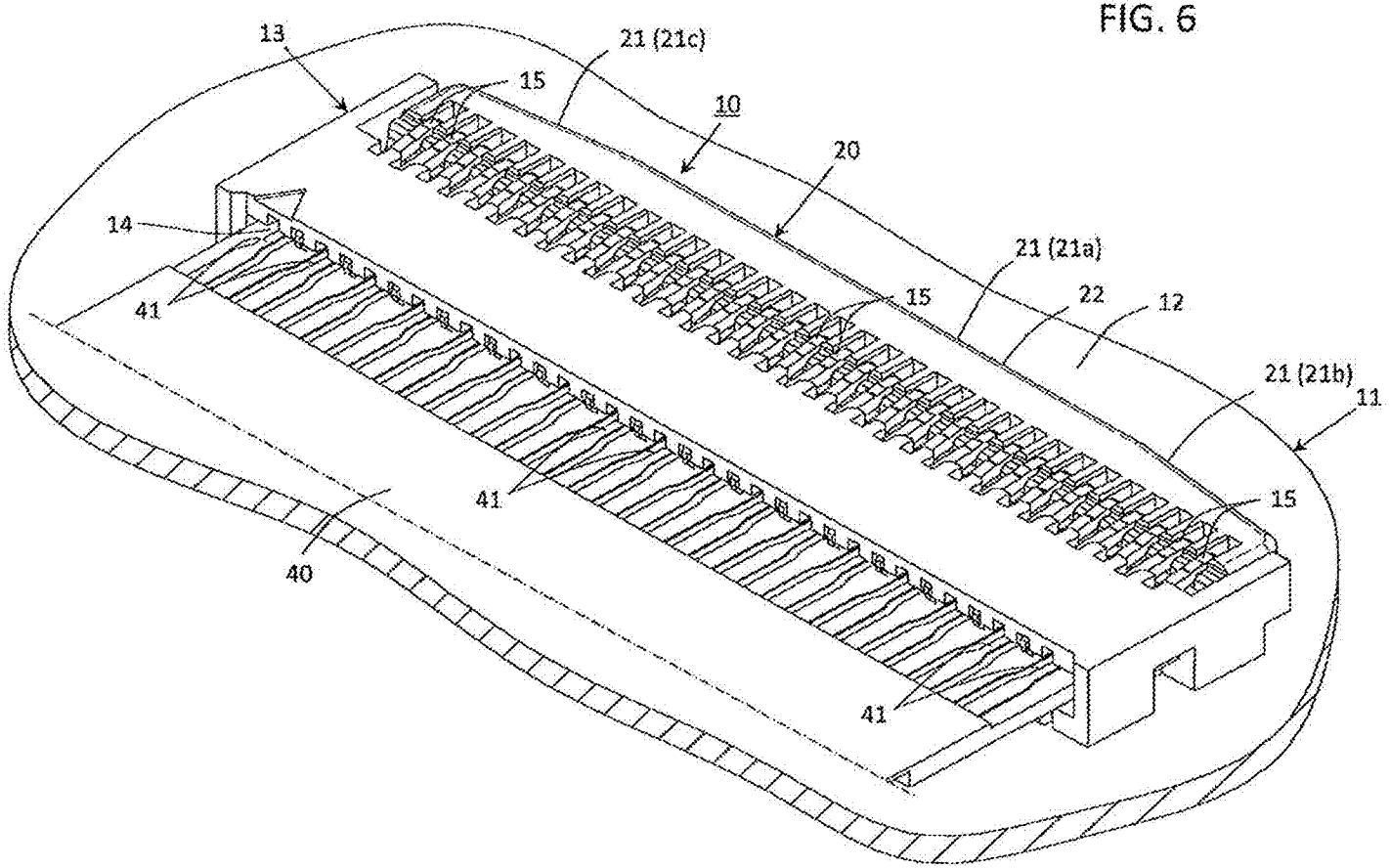
FIG. 6 is a schematic perspective view showing the first embodiment of electrical connector according to the present invention, together with a part of the main circuit board of the electronic apparatus to which the first embodiment is fixed and a part of a flexible printed circuit board inserted into the first embodiment.
Figure 7:
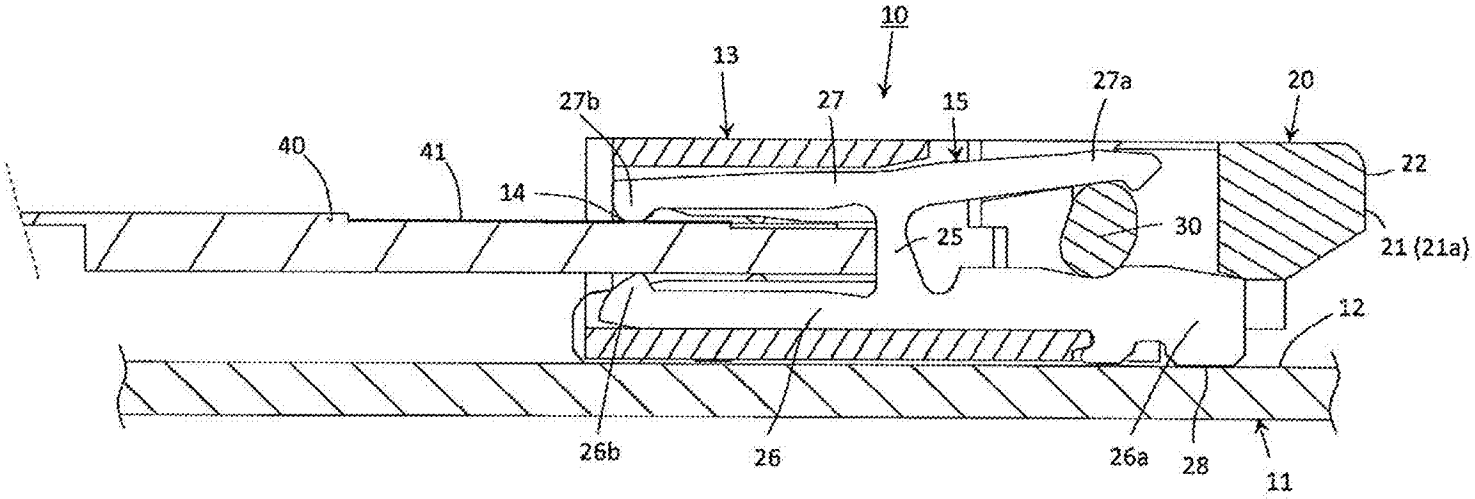
FIG. 7 is a schematic cross sectional view showing the first embodiment of electrical connector according to the present invention, together with a part of the main circuit board of the electronic apparatus to which the first embodiment is fixed and a part of the flexible printed circuit board inserted into the first embodiment.

The actuator 20 is postured to take first and second stations selectively. In the first station, the actuator 20 keeps rising from the outer surface 12 of the main circuit board 11 on which the housing 13 is mounted, as shown in FIGS. 1 to 3, and in the second station, the actuator 20 keeps lying down on the outer surface 12 of the main circuit board 11 on which the housing is mounted, as shown in FIGS. 6 and 7 described later. Then, the actuator 20 is rotated in regard to the housing 13 to shift from the first station to the second station or from the second station to the first station.

Figure 4:
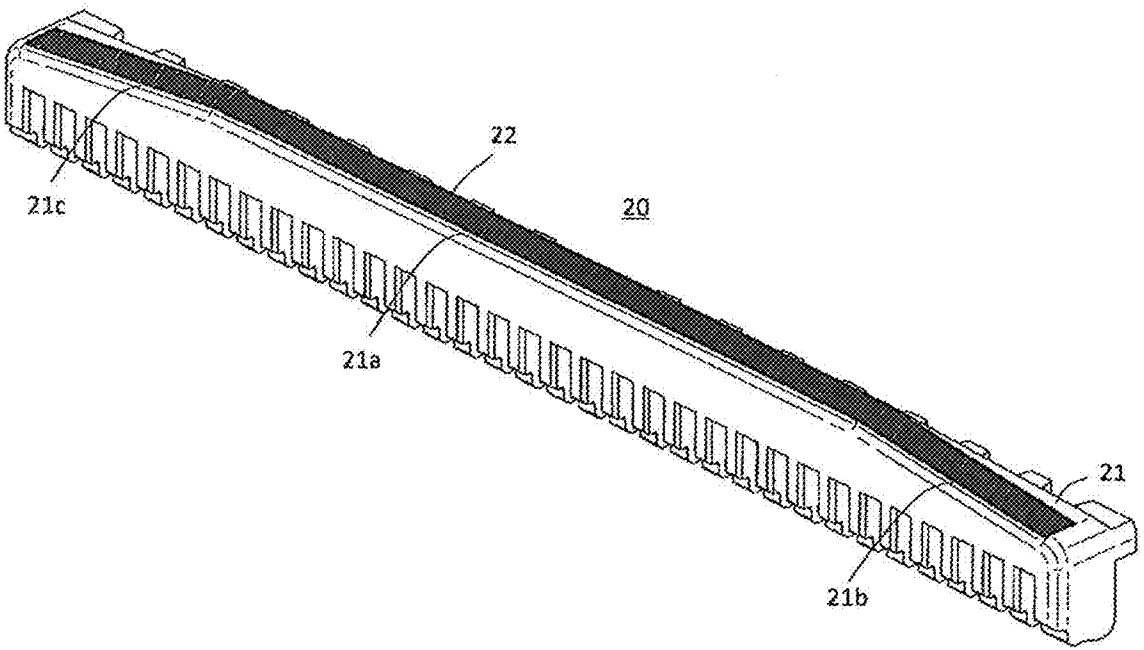
FIG. 4 is a schematic perspective view showing an actuator employed in the first embodiment of electrical connector according to the present invention.

As shown clearly in FIG. 4, the actuator 20 has a particular outer portion 21 thereof which faces upward on the outer surface 12 of the main circuit board 11 on which the housing 13 is mounted when the actuator 20 takes the first station to keep rising from the outer surface 12 of the main circuit board 11 and faces toward a direction in parallel with the outer surface 12 of the main circuit board 11 on which the housing 13 is mounted when the actuator 20 takes the second station to keep laying down on the outer surface 12 of the main circuit board 11. The particular outer portion 21 of the actuator 20 is constituted with a central flat portion 21*a* and a pair of slant portions 21*b* and 21*c* opposite to each other with the central flat portion 21*a* between.

On the actuator 20, a discriminative area 22 is provided in such a manner as to extend over almost the whole of the central flat portion 21*a* and the slant portions 21*b* and 21*c* of the particular outer portion 21. That is, the discriminative area 22 is provided on the particular outer portion 21 of the actuator 20 so as to extend almost all over the particular outer portion 21.

The discriminative area 22 is formed by, for example, coating the particular outer portion 21 of the actuator 20 with a predetermined paint, attaching a predetermined colored member to the particular outer portion 21 of the actuator 20, providing on the particular outer portion 21 of the actuator 20 with a rough surface produced by irradiation of a laser light beam or providing on the particular outer portion 21 of the actuator 20 with a surface processed by the sand-blasting method, so as to present a color or an ornamental patter different from that on other areas on the actuator 20 and the housing 13. The discriminative area 22 thus provided on the particular outer portion 21 of the actuator 20 faces upward on the outer surface 12 of the main circuit board 11 on which the housing 13 is mounted to present a color or an ornamental patter different from that on other areas on the actuator 20 and the housing 13 when the actuator 20 is positioned in the first station to keep rising from the outer surface 12 of the main circuit board 11. Accordingly, the discriminative area 22 on the particular outer portion 21 of the actuator 20 becomes conspicuous in a sight of birds eye view on the outer surface 12 of the main circuit board 11 when the actuator 20 is positioned in the first station to keep rising from the outer surface 12 of the main circuit board 11 and therefore the actuator 20 positioned in the first station can be recognized quite easily by observation from the outside of the housing 13.

Figure 5:
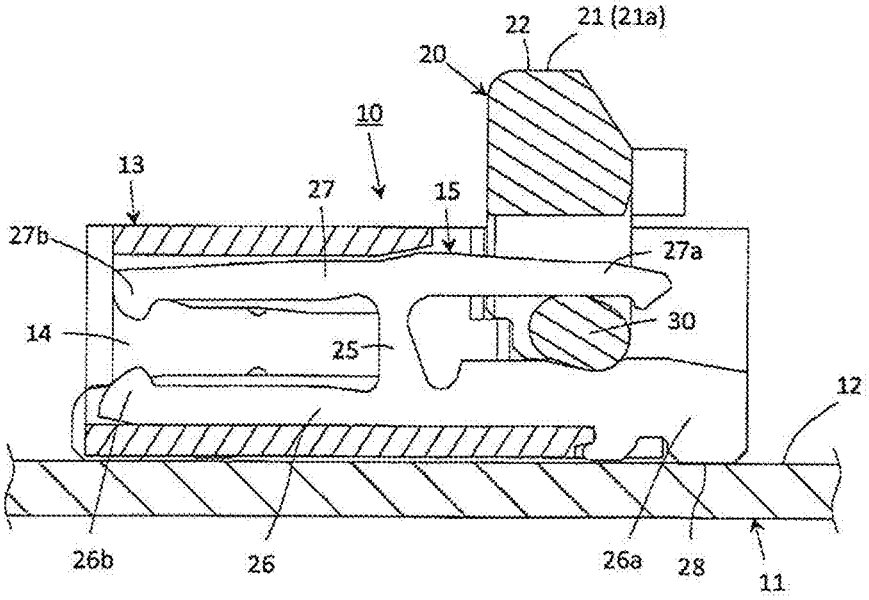
FIG. 5 is a schematic cross sectional view taken along line V-V on FIG. 3.

Each of the conductive contacts 15 is made of conductive resilient material and formed entirely into an H-shaped plate member, as shown in FIG. 5 showing a cross sectional view taken along line V-V on FIG. 3.

Referring to FIG. 5, the conductive contact 15 thus formed entirely into the H-shaped plate member has a fixed beam 26 fixed to the housing 13, a movable beam 27 which is able to shift its position in the housing 13 for serving as an operating portion of the conductive contact 15 and a connecting strut 25 for connecting the movable beam 27 with the fixed beam 26 to support the movable beam 27.

The fixed beam 26 of the conductive contact 15 has an end portion 26*a* extending to the outside of the housing 13 to form a connecting terminal which is to be electrically connected with a conducting circuit pattern portion provided on the outer surface 12 of the main circuit board 11 on which the housing 13 is mounted.

The actuator 20 which is rotatable in regard to the housing 13 is provided with a plurality of cams 30 operative to engage with the conductive contacts 15 respectively in the housing 13, as shown in FIG. 5. Each of the cams 30 has an oval cross section to be put between the end portion 26*a* of the fixed beam 26 and an end portion 27*a* of the movable beam 27 of a corresponding one of the conductive contacts 15 and operative to rotate when the actuator 20 is rotated, as shown in FIG. 5. The end portion 27*a* of the movable beam 27 is positioned to be opposite to the end portion 26*a* of the fixed beam 26.

The cam 30 has a portion thereof in which the oval cross section has the maximum diametral dimension measured across in a direction which varies with a rotating movement of the actuator 20. Hereinafter, this portion of the cam 30 is referred to as a maximum diametral dimension portion.

When the actuator 20 is positioned in the first station as shown in FIGS. 1 to 3, a portion of each of the cams 30 other than the maximum diametral dimension portion thereof engages with both of the end portion 26*a* of the fixed beam 26 and the end portion 27*a* of the movable beam 27 of the corresponding one of the conductive contacts 15. Under such a situation, in the conductive contact 15 corresponding to each of the cams 30, another end portion 26*b* of the fixed beam 26 and another end portion 27*b* of the movable beam 27 are opposite to each other with a relatively large space between at the opening 14 provided on the housing 13.

Then, an end portion of the flexible printed circuit board 40 (shown in FIGS. 6 and 7) as the circuit board is inserted into the housing 13 through the opening 14 provided thereon when the actuator 20 is positioned in the first station. At this time, the conductive contact 15 arranged in the housing 13 are positioned to correspond respectively to a plurality of connecting terminals 41 (shown in FIGS. 6 and 7) provided on the end portion of the flexible printed circuit board 40 inserted in the housing 13. After the end portion of the flexible printed circuit board 40 has been inserted in the housing 13 through the opening 14 provided thereon, when the actuator 20 is rotated to shift from the first station to the second station for lying down on the outer surface 12 of the main circuit board on which the housing in mounted, as shown in FIGS. 6 and 7, the conductive contacts 15 arranged in the housing 13 come into press-contact respectively with the connecting terminals 41 provided on the end portion of the flexible printed circuit board 40 inserted in the housing 13.

On that occasion, first, in the condition wherein the actuator 20 is positioned in the first station, the end portion of the flexible printed circuit board 40 inserted in the housing 13 is put between the fixed beam 26 and the movable beam 27 of each of the conductive contacts 15 arranged in the housing 13. Then, the actuator 20 is rotated to shift from the first station to the second station so as to lie down on the outer surface 12 of the main circuit board 11 on which the housing 13 is mounted. With such a movement of the actuator 20 from the first station to the second station, the maximum diametral dimension portion of each of the cams 30 provided on the actuator 20 comes to engage with both of the end portion 26*a* of the fixed beam 26 and the end portion 27*a* of the movable beam 27 of the corresponding one of the conductive contacts 15.

The maximum diametral dimension portion of each of the cams 30 put in engagement with both of the end portion 26*a* of the fixed beam 26 and the end portion 27*a* of the movable beam 27 of the corresponding one of the conductive contacts 15, is operative to move the movable beam 27 for reducing the space between the end portion 26*b* of the fixed beam 26 and the end portion 27*b* of the movable beam 27 at the opening 14 provided on the housing 13 so that the end portion 27*b* of the movable beam 27 comes into press-contact with a corresponding one of the connecting terminals 41 provided on the end portion of the flexible printed circuit board 40 inserted in the housing 13. Thereby, each of the connecting terminals 41 provided on the end portion of the flexible printed circuit board 40 inserted in the housing 13 is electrically connected with a conductive circuit pattern portion 28 formed on the outer surface 12 of the main circuit board 11.

When the actuator 20 is positioned in the second station to keep lying down on the outer surface 12 of the main circuit board 11 on which the housing 13 is mounted, the discriminative area 22 provided on the particular outer portion 21 of the actuator 20 faces toward the direction in parallel with the outer surface 12 of the main circuit board 11, as shown in FIG. 7. Therefore, although the discriminative area 22 is provided for presenting the color or the ornamental pattern different from that on other areas on the actuator 20 and the housing 13, the discriminative area 22 facing toward the direction in parallel with the outer surface 12 of the main circuit board 11 becomes inconspicuous in the sight of birds eye view on the outer surface 12 of the main circuit board 11. As a result, with the discriminative area 22 which is inconspicuous in the sight of birds eye view on the outer surface 12 of the main circuit board 11, the actuator 20 positioned in the second station can be recognized easily by observation from the outside of the housing 13.

After that, the actuator 20 positioned in the second station is moved into the first station for releasing each of the conductive contacts 15 from the press-contact with the corresponding one of the connecting terminals 41 provided on the end portion of the flexible printed circuit board 40 inserted in the housing 13, as occasion demands.

When the actuator 20 positioned in the second station is moved into the first station, the actuator 20 is rotated to shift from the second station to the first station so as to rise from the outer surface 12 of the main circuit board 11 on which the housing 13 is mounted. With such a movement of the actuator 20 from the second station to the first station, the portion of each of the cams 30 provided on the actuator 20 other than the maximum diametral dimension portion comes to engage with both of the end portion 26*a* of the fixed beam 26 and the end portion 27*a* of the movable beam 27 of the corresponding one of the conductive contacts 15.

The portion of each of the cams 30 other than the maximum diametral dimension portion put in engagement with both of the end portion 26*a* of the fixed beam 26 and the end portion 27*a* of the movable beam 27 of the corresponding one of the conductive contacts 15, is operative to move the movable beam 27 for enlarge the space between the end portion 26*b* of the fixed beam 26 and the end portion 27*b* of the movable beam 27 at the opening 14 provided on the housing 13 so that the end portion 27*b* of the movable beam 27 is released from the press-contact with the corresponding one of the connecting terminals 41 provided on the end portion of the flexible printed circuit board 40 inserted in the housing 13. Thereby, each of the conductive contacts 15 is released from the press-contact with the corresponding one of the connecting terminals 41 provided on the end portion of the flexible printed circuit board 40 inserted in the housing 13 and the flexible printed circuit board 40 can be appropriately drawn out of the housing 13 through the opening 14 provided thereon.

As described above, in the electrical connector 10, the discriminative area 22 provided on the particular outer portion 21 of the actuator 20 is operative to face upward on the outer surface 12 of the main circuit board 11 on which the housing 13 is mounted for presenting the color or the ornamental patter different from that on other areas on the actuator 20 and the housing 13 so as to become conspicuous in the sight of birds eye view on the outer surface 12 of the main circuit board 11 when the actuator 20 is positioned in the first station to keep rising from the outer surface 12 of the main circuit board 11, as shown in FIG. 5, and to face toward the direction in parallel with the outer surface 12 of the main circuit board 11 on which the housing 13 is mounted for presenting the color or the ornamental patter different from that on other areas on the actuator 20 and the housing 13 so as to become inconspicuous in the sight of birds eye view on the outer surface 12 of the main circuit board 11 when the actuator 20 is positioned in the second station to keep lying down on the outer surface 12 of the main circuit board 11, as shown in FIG. 7.

Consequently, the condition wherein the actuator 20 is positioned in the first station to keep rising from the outer surface 12 of the main circuit board 11 on which the housing 13 is mounted for releasing each of the conductive contacts 15 arranged in the housing 13 from the press-contact with the connecting terminal 41 provided on the flexible printed circuit board 40 inserted in the housing 13 can be distinguished easily and clearly from the condition wherein the actuator 20 is positioned in the second station to keep lying down on the outer surface 12 of the main circuit board 11 on which the housing 13 is mounted for causing each of the conductive contacts 15 arranged in the housing 13 to maintain the press-contact with the connecting terminal 41 provided on the flexible printed circuit board 40 inserted in the housing 13, by means of observation in the sight of birds eye view on the outer surface 12 of the main circuit board 11, that is, observation from the outside of the housing 13.

Further, with the electrical connector 10, since the condition wherein the actuator 20 is operating to release each of the conductive contacts 15 from the press-contact with the connecting terminal 41 provided on the flexible printed circuit board 40 inserted in the housing 13 can be distinguished easily and clearly from the condition wherein the actuator 20 is operating to cause each of the conductive contacts 15 to maintain the press-contact with the connecting terminal 41 on the flexible printed circuit board 40, by means of providing the discriminative area 22 on the particular outer portion 21 of the actuator 20, it is not necessary to provide on the housing 13 or the actuator 20 with any specific member such as the press-discoloring member or the electrical paper. Thereby, each of the housing 13 and the actuator 20 can be simplified in its configuration and the production cost of the electrical connector 10 can be reduced.

Figure 8:
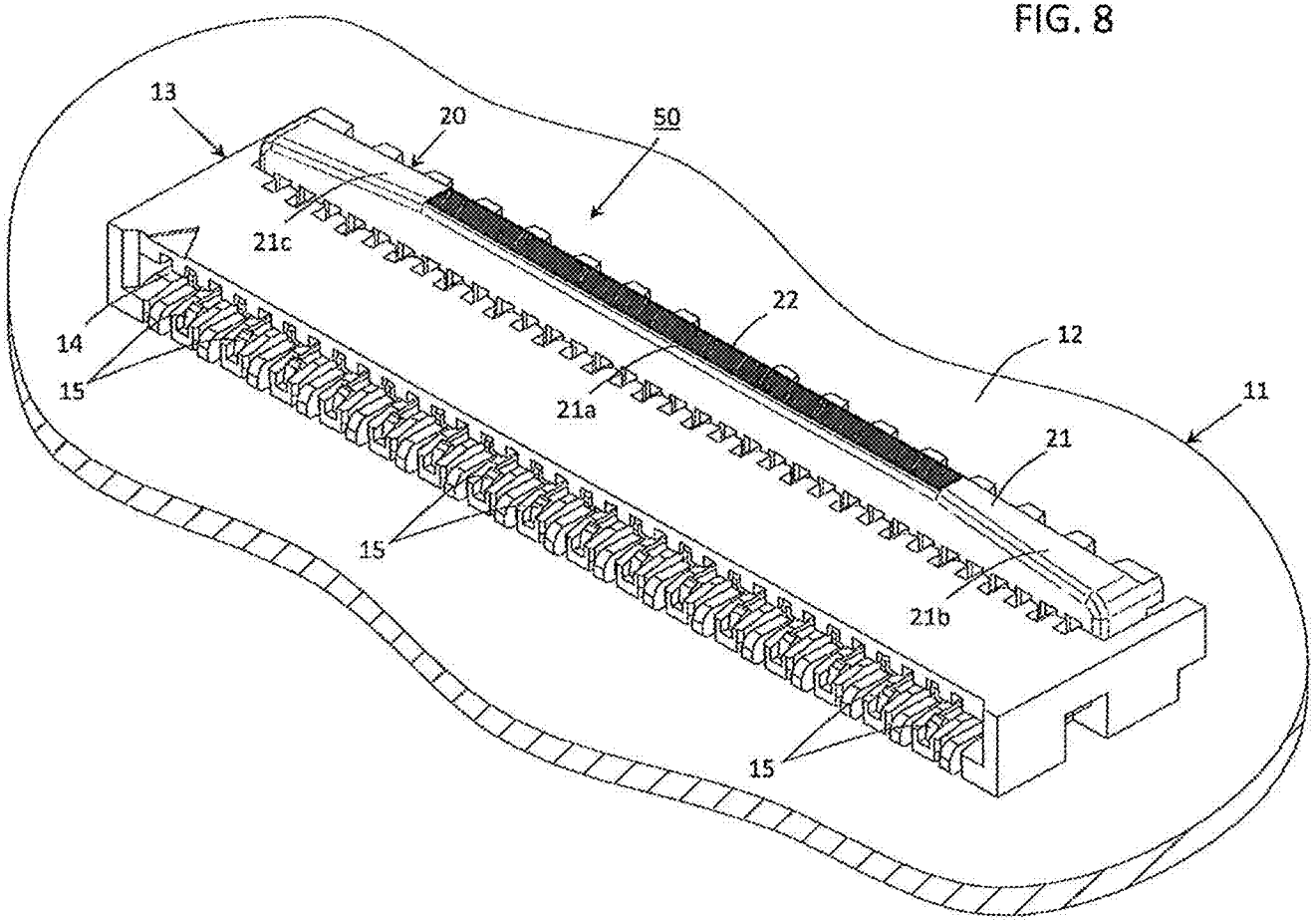
FIG. 8 is a schematic perspective view showing a second embodiment of electrical connector according to the present invention, together with a part of a main circuit board of an electronic apparatus to which the second embodiment is fixed.

FIG. 8 shows a second embodiment of electrical connector according to the present invention, together with a part of a main circuit board on which the second embodiment is fixed.

Referring to FIG. 8, an electrical connector 50, which constitutes the second embodiment of electrical connector according to the present invention, has various portions and members constituted in the same manner as those of the electrical connector 10 which constitutes the first embodiment of electrical connector according to the present invention as described above to be shown in FIG. 8 with reference numerals common with the electrical connector 10. Detailed descriptions of the portions and members in the electrical connector 50 shown with the reference numerals common with the electrical connector 10 will be omitted.

In the electrical connector 50 also, a discriminative area 22 which presents a color or an ornamental pattern different from that on other areas of an actuator 20 and a housing 13 is provided on a particular outer portion 21 of the actuator 20 which faces upward on an outer surface 12 of a main circuit board 11 on which the housing 13 is mounted when the actuator 20 is positioned in a first station to keep rising from the outer surface 12 of the main circuit board 11 and faces toward a direction in parallel with the outer surface 12 of the main circuit board 11 on which the housing 13 is mounted when the actuator 20 is positioned in a second station to keep lying down on the outer surface 12 of the main circuit board 11. However, the discriminative area 22 is not provided to extend over almost the whole of a central flat portion 21*a* and slant portions 21*b* and 21*c* of the particular outer portion 21 but provided to extend only on the central flat portion 21*a* of the particular outer portion 21.

The discriminative area 22 thus provided on the central flat portion 21*a* of the particular outer portion 21 of the actuator 20 is also formed by, for example, coating the particular outer portion 21 of the actuator 20 with a predetermined paint, attaching a predetermined colored member to the particular outer portion 21 of the actuator 20, providing on the particular outer portion 21 of the actuator 20 with a rough surface produced by irradiation of a laser light beam or providing on the particular outer portion 21 of the actuator 20 with a surface processed by the sand-blasting method, so as to present the color or the ornamental patter different from that on other areas on the actuator 20 and the housing 13.

Accordingly, when the actuator 20 is positioned in the first station to keep rising from the outer surface 12 of the main circuit board 11 on which the housing 13 is mounted, the discriminative area 22 provided on the central flat portion 21*a* of the particular outer portion 21 of the actuator 20 faces upward on the outer surface 12 of the main circuit board 11 to present the color or the ornamental patter different from that on other areas on the actuator 20 and the housing 13 so as to become conspicuous in a sight of birds eye view on the outer surface 12 of the main circuit board 11 and therefore the actuator 20 positioned in the first station can be recognized quite easily by observation from the outside of the housing 13.

Other portions and parts of the electrical connector 50 are constituted in the same manner as those of the electrical connector 10 and therefore, with the electrical connector 50, the same effect and advantages as those obtained with the electrical connector 10 can be also obtained.

Figure 9:
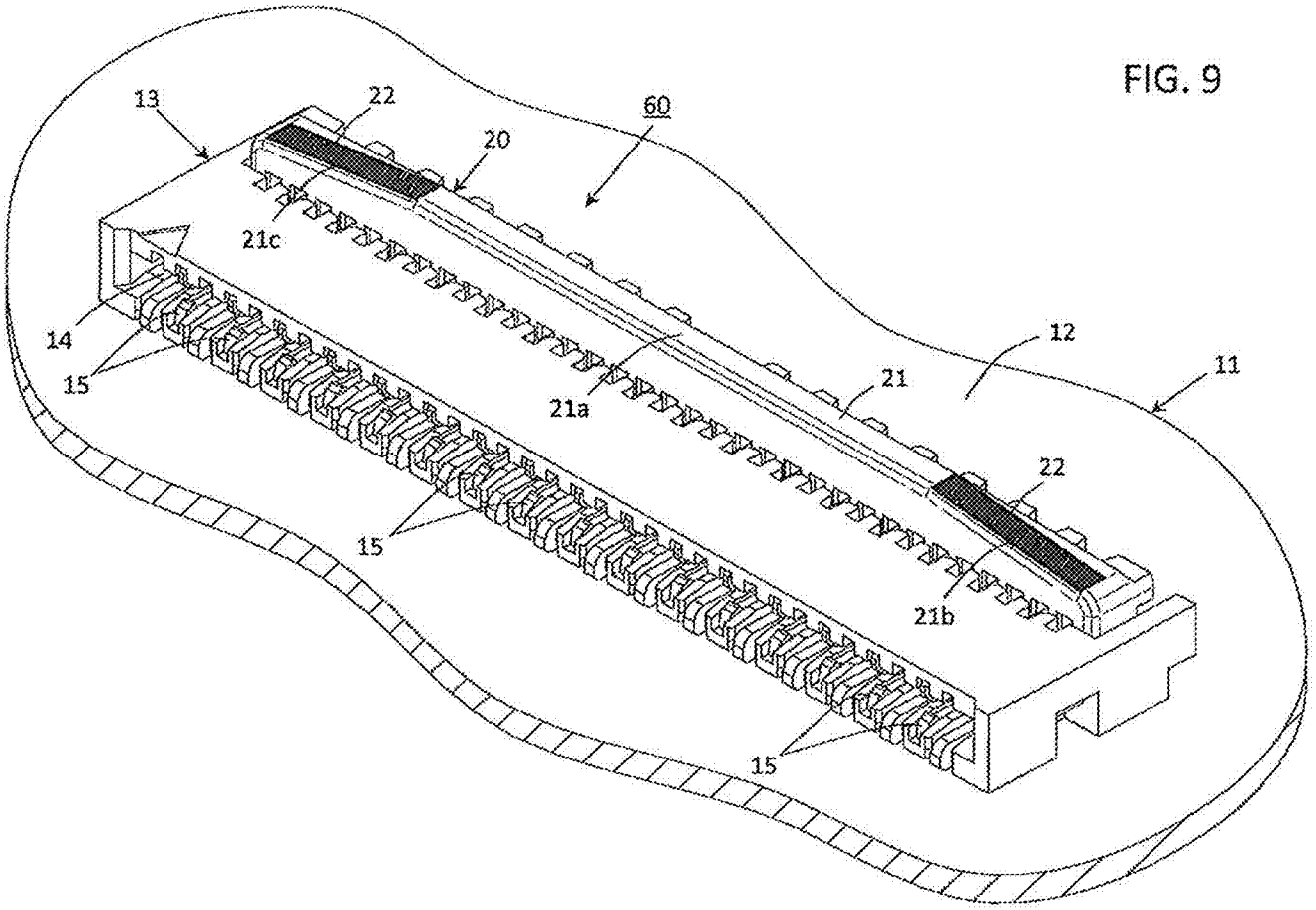
FIG. 9 is a schematic perspective view showing a third embodiment of electrical connector according to the present invention, together with a part of a main circuit board of an electronic apparatus to which the third embodiment is fixed.

FIG. 9 shows a third embodiment of electrical connector according to the present invention, together with a part of a main circuit board on which the third embodiment is fixed.

Referring to FIG. 9, an electrical connector 60, which constitutes the third embodiment of electrical connector according to the present invention, has various portions and members constituted in the same manner as those of the electrical connector 10 which constitutes the first embodiment of electrical connector according to the present invention as described above to be shown in FIG. 9 with reference numerals common with the electrical connector 10. Detailed descriptions of the portions and members in the electrical connector 60 shown with the reference numerals common with the electrical connector 10 will be omitted.

In the electrical connector 60 also, a discriminative area 22 which presents a color or an ornamental pattern different from that on other areas of an actuator 20 and a housing 13 is provided on a particular outer portion 21 of the actuator 20 which faces upward on an outer surface 12 of a main circuit board 11 on which the housing 13 is mounted when the actuator 20 is positioned in a first station to keep rising from the outer surface 12 of the main circuit board 11 and faces toward a direction in parallel with the outer surface 12 of the main circuit board 11 on which the housing 13 is mounted when the actuator 20 is positioned in a second station to keep lying down on the outer surface 12 of the main circuit board 11. However, the discriminative area 22 is not provided to extend over almost the whole of a central flat portion 21*a* and slant portions 21*b* and 21*c* of the particular outer portion 21 but provided to extend only on the slant portions 21*b* and 21*c* of the particular outer portion 21. Thereby, the discriminative area 22 is divided into a couple of areas opposite to each other with the central flat portion 21*a* of the particular outer portion 21.

The discriminative area 22 thus provided on the slant portions 21*b* and 21*c* of the particular outer portion 21 is also formed by, for example, coating the particular outer portion 21 of the actuator 20 with a predetermined paint, attaching a predetermined colored member to the particular outer portion 21 of the actuator 20, providing on the particular outer portion 21 of the actuator 20 with a rough surface produced by irradiation of a laser light beam or providing on the particular outer portion 21 of the actuator 20 with a surface processed by the sand-blasting method, so as to present the color or the ornamental patter different from that on other areas on the actuator 20 and the housing 13.

Accordingly, when the actuator 20 is positioned in the first station to keep rising from the outer surface 12 of the main circuit board 11 on which the housing 13 is mounted, the discriminative area 22 provided on the slant portions 21*b* and 21*c* of the particular outer portion 21 of the actuator 20 faces upward on the outer surface 12 of the main circuit board 11 to present the color or the ornamental patter different from that on other areas on the actuator 20 and the housing 13 so as to become conspicuous in a sight of birds eye view on the outer surface 12 of the main circuit board 11 and therefore the actuator 20 positioned in the first station can be recognized quite easily by observation from the outside of the housing 13.

Other portions and parts of the electrical connector 60 are constituted in the same manner as those of the electrical connector 10 and therefore, with the electrical connector 60, the same effect and advantages as those obtained with the electrical connector 10 can be also obtained.

Figure 10:
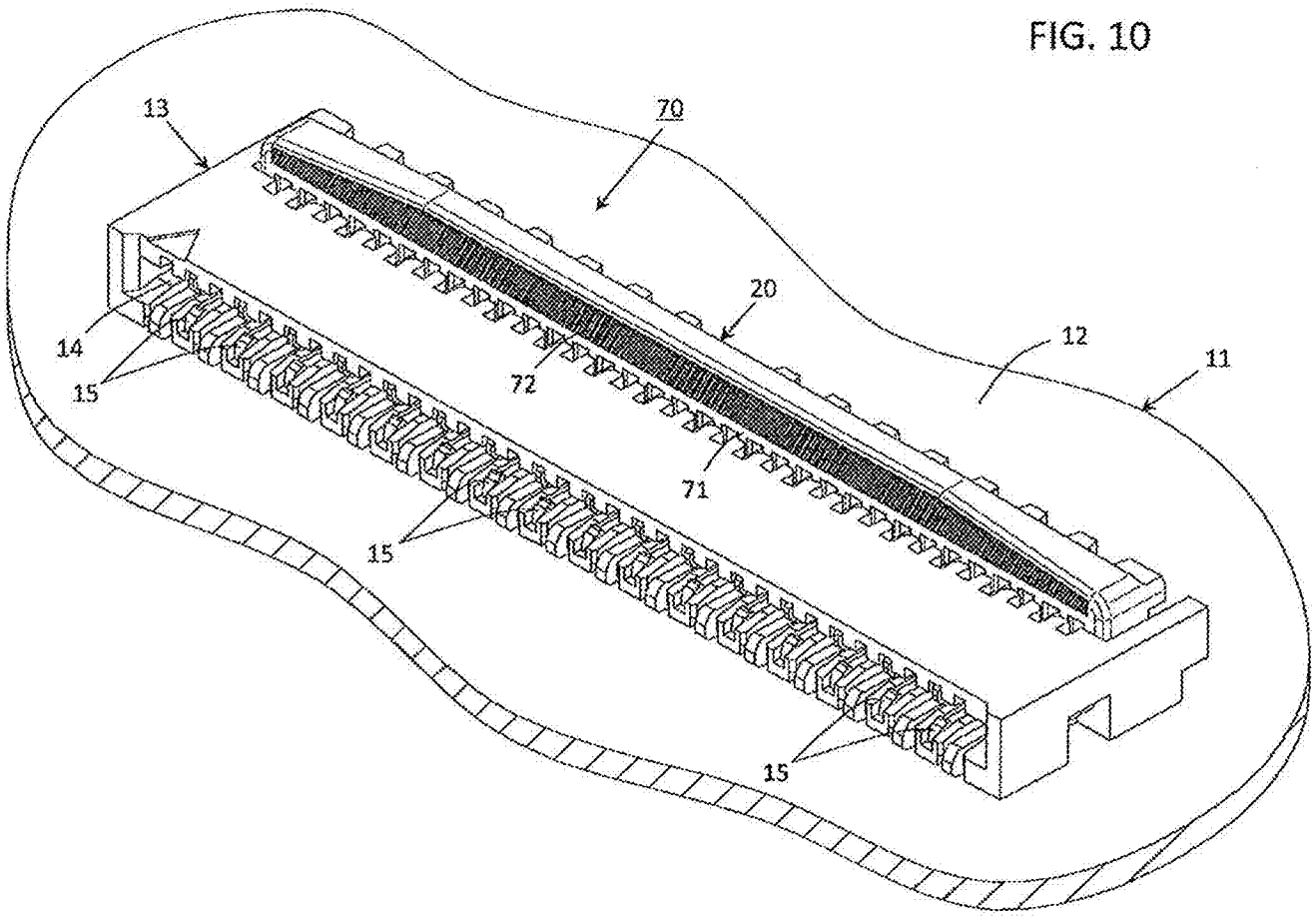
FIG. 10 is a schematic perspective view showing a fourth embodiment of electrical connector according to the present invention, together with a part of a main circuit board of an electronic apparatus to which the fourth embodiment is fixed.

FIG. 10 shows a fourth embodiment of electrical connector according to the present invention, together with a part of a main circuit board on which the fourth embodiment is fixed.

Referring to FIG. 10, an electrical connector 70, which constitutes the fourth embodiment of electrical connector according to the present invention, has various portions and members constituted in the same manner as those of the electrical connector 10 which constitutes the first embodiment of electrical connector according to the present invention as described above to be shown in FIG. 10 with reference numerals common with the electrical connector 10. Detailed descriptions of the portions and members in the electrical connector 70 shown with the reference numerals common with the electrical connector 10 will be omitted.

In the electrical connector 70, an actuator 20 has a particular outer portion 71 thereof which faces toward a direction in parallel with an outer surface 12 of a main circuit board 11 on which a housing 13 is mounted when the actuator 20 takes a first station to keep rising from the outer surface 12 of the main circuit board 11 and faces upward on the outer surface 12 of the main circuit board 11 on which the housing 13 is mounted when the actuator 20 takes a second station to keep lying down on the outer surface 12 of the main circuit board 11. The particular outer portion 71 of the actuator 20 has a flat surface on the whole.

On the particular outer portion 71 of the actuator 20, a discriminative area 72 is provided in such a manner as to extend over almost the whole of the particular outer portion 71. The discriminative area 72 is formed by, for example, coating the particular outer portion 71 of the actuator 20 with a predetermined paint, attaching a predetermined colored member to the particular outer portion 71 of the actuator 20, providing on the particular outer portion 71 of the actuator 20 with a rough surface produced by irradiation of a laser light beam or providing on the particular outer portion 71 of the actuator 20 with a surface processed by the sand-blasting method, so as to present a color or an ornamental patter different from that on other areas on the actuator 20 and the housing 13. The discriminative area 72 thus provided on the particular outer portion 71 of the actuator 20 faces toward the direction in parallel with the outer surface 12 of the main circuit board 11 on which the housing 13 is mounted to present the color or the ornamental patter different from that on other areas on the actuator 20 and the housing 13 when the actuator 20 is positioned in the first station to keep rising from the outer surface 12 of the main circuit board 11 and faces upward on the outer surface 12 of the main circuit board 11 on which the housing 13 is mounted to present the color or the ornamental patter different from that on other areas on the actuator 20 and the housing 13 when the actuator 20 is positioned in the second station to keep lying down on the outer surface 12 of the main circuit board 11.

Accordingly, the discriminative area 72 on the particular outer portion 71 of the actuator 20 becomes inconspicuous in a sight of birds eye view on the outer surface 12 of the main circuit board 11 when the actuator 20 is positioned in the first station to keep rising from the outer surface 12 of the main circuit board 11, and therefore, with the discriminative area 72 which is inconspicuous in the sight of birds eye view on the outer surface 12 of the main circuit board 11, the actuator 20 positioned in the first station can be recognized easily by observation from the outside of the housing 13. On the other hand, the discriminative area 72 on the particular outer portion 71 of the actuator 20 becomes conspicuous in the sight of birds eye view on the outer surface 12 of the main circuit board 11 when the actuator 20 is positioned in the second station to keep lying down on the outer surface 12 of the main circuit board 11, and therefore, with the discriminative area 72 which is conspicuous in the sight of birds eye view on the outer surface 12 of the main circuit board 11, the actuator 20 positioned in the second station can be recognized easily by observation from the outside of the housing 13.

Other portions and parts of the electrical connector 70 are constituted in the same manner as those of the electrical connector 10.

In the electrical connector 70 thus constituted, the discriminative area 72 provided on the particular outer portion 71 of the actuator 20 is operative to face toward the direction in parallel with the outer surface 12 of the main circuit board 11 on which the housing 13 is mounted for presenting the color or the ornamental patter different from that on other areas on the actuator 20 and the housing 13 so as to become inconspicuous in the sight of birds eye view on the outer surface 12 of the main circuit board 11 when the actuator 20 is positioned in the first station to keep rising from the outer surface 12 of the main circuit board 11, and to face upward on the outer surface 12 of the main circuit board 11 on which the housing 13 is mounted for presenting the color or the ornamental patter different from that on other areas on the actuator 20 and the housing 13 so as to become conspicuous in the sight of birds eye view on the outer surface 12 of the main circuit board 11 when the actuator 20 is positioned in the second station to keep lying down on the outer surface 12 of the main circuit board 11.

Consequently, the condition wherein the actuator 20 is positioned in the first station to keep rising from the outer surface 12 of the main circuit board 11 on which the housing 13 is mounted for releasing each of the conductive contacts 15 arranged in the housing 13 from the press-contact with the connecting terminal 41 provided on the flexible printed circuit board 40 inserted in the housing 13 can be distinguished easily and clearly from the condition wherein the actuator 20 is positioned in the second station to keep lying down on the outer surface 12 of the main circuit board 11 on which the housing 13 is mounted for causing each of the conductive contacts 15 arranged in the housing 13 to maintain the press-contact with the connecting terminal 41 provided on the flexible printed circuit board 40 inserted in the housing 13, by means of observation in the sight of birds eye view on the outer surface 12 of the main circuit board 11, that is, observation from the outside of the housing 13.

Further, with the electrical connector 70, since the condition wherein the actuator 20 is operating to release each of the conductive contacts 15 from the press-contact with the connecting terminal 41 provided on the flexible printed circuit board 40 inserted in the housing 13 can be distinguished easily and clearly from the condition wherein the actuator 20 is operating to cause each of the conductive contacts 15 to maintain the press-contact with the connecting terminal 41 on the flexible printed circuit board 40, by means of providing the discriminative area 72 on the particular outer portion 71 of the actuator 20, it is not necessary to provide on the housing 13 or the actuator 20 with any specific member such as the press-discoloring member or the electrical paper. Thereby, each of the housing 13 and the actuator 20 can be simplified in its configuration and the production cost of the electrical connector 70 can be reduced.

Incidentally, although the discriminative area 72 is provided to extend over almost the whole of the particular outer portion 71 of the actuator 20 in the electrical connector 70, it is possible to provide on the actuator 20 of the electrical connector 70 with the discriminative area 72 extending only on a part of or a plurality of parts of the particular outer portion 71. Further, it is also possible to discriminate variations of the electrical connector 70 with changes in position of the discriminative area 72 or changes in color or ornamental patter of the discriminative area 72.

The invention claimed is:

1. An electrical connector having an observable discriminative area, said electrical connector comprising:

a housing made of an insulator to be mounted on an outer surface of a main circuit board and provided with an opening through which a flat circuit device is inserted into the housing, a plurality of conductive contacts provided to be arranged in the housing and positioned to correspond respectively to connecting terminals provided on the flat circuit device when the flat circuit device is inserted in the housing through the opening provided thereon, and an actuator provided to be rotatable in regard to the housing for taking a first station and a second station selectively to engage with the conductive contacts for causing each of the conductive contacts to come into press-contact with one of the connecting terminals corresponding thereto when the flat circuit device is inserted in the housing through the opening provided thereon and the actuator is shifted from the first station to the second station and for causing each of the conductive contacts to get out of press-contact with the corresponding one of the connecting terminals when the flat circuit device has been inserted in the housing and the actuator is shifted from the second station to the first station, the actuator being provided with an outside portion which faces upward on the outer surface of the main circuit board on which the housing is mounted when the actuator takes the first station and is constituted with a central flat portion and a pair of slant portions opposite to each other with the central flat portion positioned between the slant portions, wherein the actuator has a particular outer portion thereof which faces upward on the outer surface of the main circuit board on which the housing is mounted when the actuator takes one of the first and second stations and faces toward a direction in parallel with the outer surface of the main circuit board on which the housing is mounted when the actuator takes the other of the first and second stations, and wherein a discriminative area presenting one of a color and an ornamental pattern different from that on other areas on the actuator and the housing is provided on the particular outer portion of the actuator.

2. The electrical connector according to claim 1, wherein the discriminative area is formed by coating the particular outer portion of the actuator with a predetermined paint.

3. The electrical connector according to claim 1, wherein the discriminative area is formed by attaching a predetermined colored member to the particular outer portion of the actuator.

4. The electrical connector according to claim 1, wherein the discriminative area is formed by providing on the particular outer portion of the actuator with a rough surface produced by irradiation of a laser light beam.

5. The electrical connector according to claim 1, wherein the discriminative area is formed by providing on the particular outer portion of the actuator with a surface processed by a sand-blasting method.

6. The electrical connector according to claim 1, wherein the discriminative area is provided to extend almost all over the particular outer portion of the actuator.

7. The electrical connector according to claim 1, wherein the discriminative area is provided to extend on a plurality of parts of the particular outer portion of the actuator.

8. The electrical connector according to claim 1, wherein the actuator is made of an insulator of a same kind as the insulator of which the housing is made so as to present the same color as the housing.

9. The electrical connector according to claim 1, wherein the actuator is made of an insulator of a same kind as the insulator of which the housing is made so as to present a color similar to the housing.

* * * * *